United States Patent [19]

Malghan

[11] Patent Number: 4,585,549

[45] Date of Patent: Apr. 29, 1986

[54] FLOTATION OF UPPER ZONE COPPER SULFIDE ORES

[75] Inventor: Subhaschandra G. Malghan, Cypress, Tex.

[73] Assignee: Exxon Research & Enginerring Company, Florham Park, N.J.

[21] Appl. No.: 574,717

[22] Filed: Jan. 30, 1984

[51] Int. Cl.[4] ..... B03D 1/02

[52] U.S. Cl. ..... 209/166; 209/1; 75/2

[58] Field of Search ..... 209/1, 3, 9, 10, 166, 209/167; 75/2

[56] References Cited

U.S. PATENT DOCUMENTS

| | | | |
|---|---|---|---|
| 3,570,772 | 3/1971 | Booth | 209/10 |
| 3,655,044 | 4/1972 | Delaney | 209/167 |
| 3,883,421 | 3/1975 | Cutting et al. | 209/1 |
| 4,011,072 | 3/1977 | Holman | 209/166 |

*Primary Examiner*—Bernard Nozick

*Attorney, Agent, or Firm*—Joseph J. Dvorak

[57] ABSTRACT

The present invention comprises a method of recovering copper minerals from ores containing both sulfide and oxidized copper sulfide minerals, such as found, for example, in surface oxidized porphyry ores. Accordingly, one embodiment of the present invention comprises first conditioning a pulp of an ore containing copper sulfide and oxidized copper sulfide minerals in the presence of an alkaline agent, next subjecting the so conditioned ore to a second conditioning step in the presence of a collector, subsequently adding a surface modifying agent to the so treated ore at a rate and in an amount sufficient to decrease the platinum electrode potential of the pulp when measured against a saturated calomel electrode to a minimum of −100 mV, then conditioning the ore only for a time sufficient to achieve intimate contact between the ore particles, and thereafter subjecting the so treated ore to conventional flotation.

14 Claims, No Drawings

FLOTATION OF UPPER ZONE COPPER SULFIDE ORES

FIELD OF THE INVENTION

This invention relates to flotation of copper minerals, and more particularly to the flotation of copper sulfide ores, such as porphyry ores which contain oxidized copper sulfide minerals in the ore.

BACKGROUND OF THE INVENTION

It is well known that the rate of flotation and overall recovery of copper sulfides, such as those in porphyry ores, are substantially lower with ores which come from upper zones of ore bodies. This decrease in copper recovery and flotation rate is believed due to the weathering effects near the ground surface which results in partial oxidation of the sulfide minerals thereby forming a mixed sulfide and oxide ore. Indeed, severe oxidation can result in the formation in the ore body of zones consisting of copper oxides, carbonates, silicates and hydroxides.

A number of techniques have been proposed for treating copper sulfide ores containing copper oxides, carbonates and hydroxides so as to enhance the total recovery of the metal values. For example, in U.S. Pat. No. 3,883,421, a process is disclosed in which sulfidizing chemicals are added to an ore slurry in water to provide an optimum oxidation-reduction potential in the ore slurry during normal flotation. For copper ores, for example, such optimum oxidation-reduction potential will be in the range of about 125 to 160 millivolts. Similarly, in U.S. Pat. No. 4,011,072, the recovery of oxide and silicate copper minerals with the sulfide minerals is disclosed as being increased by adding a soluble sulfidizing agent to a pulp of the ore which addition is controlled in accordance with the pulp EMF. Specifically, the addition of the sulfidizing agent is disclosed as being discontinued whenever the EMF becomes less than about −30 millivolts as measured against a silver, silver chloride standard electrode.

It should be readily appreciated that in addition to the increase in the total amount of copper that can be recovered from sulfide ores, the rate of recovery or flotation kinetics is also of considerable importance. For example, in commercial practice an improved recovery of upper zone porphyry ores frequently is obtained by increasing the total flotation time so that the slow floating minerals will ultimately float. This practice unfortunately results in higher capital cost. If the additional flotation time, however, is not allowed, then total copper recovery is significantly decreased.

Thus, there remains a need for a process which will enhance the flotation kinetics for slow floating, surface oxidized sulfide minerals, such as the upper zone porphyry ores and which will also increase the overall copper recovery.

SUMMARY OF THE INVENTION

Briefly, the present invention comprises a method of recovering copper minerals from ores containing both sulfide and oxidized copper sulfide minerals, such as found, for example, in surface oxidized porphyry ores. Accordingly, one embodiment of the present invention comprises first conditioning a pulp of an ore containing copper sulfide and oxidized copper sulfide minerals in the presence of an alkaline agent, next subjecting the so conditioned ore to a second conditioning step in the presence of a collector, subsequently adding a surface modifying agent to the so treated ore at a rate and in an amount sufficient to decrease the platinum electrode potential of the pulp when measured against a saturated calomel electrode to a minimum of −100 mV, then conditioning the ore only for a time sufficient to achieve intimate contact between the ore particles, and thereafter subjecting the so treated ore to conventional flotation.

In another embodiment of the present invention, an alkaline conditioned ore containing copper sulfide and oxidized copper sulfide minerals is treated prior to flotation by adding a collector or mixture of collectors, optionally a frother or mixture of frothers, and a surface modifying agent such that the platinum electrode potential of the ore is descreased to below about −100 mV. Thereafter the ore is conditioned for a time sufficient to achieve intimate contact between the ore particles and surface modifying agent. After so conditioning the ore, it finally is subjected to flotation whereby the copper values are recovered at enhanced rates.

DETAILED DESCRIPTION OF THE INVENTION

The present invention is particularly suitable for the recovery of copper from porphyry copper sulfide ores that come from upper zones of an ore body. However, it should be readily appreciated that the invention also is useful in the recovery of copper minerals from any partially oxidized copper sulfide minerals.

Following the standard ore preparation procedures, porphyry copper sulfide ores from the upper zones of an ore body will first be crushed and ground in water to reduce the particle size of the ore to provide a pulp for use in a flotation operation.

In accordance with the practice of the present invention, the pulp so prepared is first conditioned in the presence of an alkaline agent or the like selected from the group consisting of alkali metal carbonates, ammonium hydroxide, potassium and calcium hydroxides or lime and mixtures of the foregoing. The amount of such alkaline agent used in conditioning the ground pulp is sufficient to provide a pulp pH greater than about 8.5, for example a pH in the range of about 8.5 to 11.0. Indeed, in the process of the present invention, it is particularly preferred to use lime as the conditioning agent and to use it in an amount sufficient to provide a pH of about 10.5.

After conditioning the ground pulp with lime, the pulp is then conditioned with a collector. Suitable collectors include xanthates, dithiophosphates, thiocarbamate, mercaptobenzothiozole and the like. The amount of collector employed is conventional and is not a part of the present invention.

Subsequent to the foregoing conditioning operations, a surface modifying agent is added to the pulp. The amount of modifying agent added depends upon the nature of the ore. Suffice it to say that the modifying agent is added at a rate and in an amount sufficient to decrease the platinum electrode potential of the pulp, when measured against a saturated calomel electrode, to below at least −100 mV, for example in the range of about −100 mV to about −300 mV. Among the surface modifying agents that have been found suitable in the practice of the present invention are sodium sulfide, lime, sodium hydroxide and the like. In the practice of the present invention, it is particularly preferred to use sodium sulfide as the modifying agent.

It is particularly important to condition the ore with the modifying agent. It also is particularly important that the ore not be overconditioned. Overconditioning results in oxidation of the surface modifying agent and its beneficial effect is diminished. Basically the ore is conditioned for a time sufficient to achieve intimate contact between the particles and the modifying agent. In general less than 4 minutes is required for conditioning the ore with the modifying agent and indeed such conditioning is usually in the range of 1 to 2 minutes. One technique for determining whether sufficient conditioning has occurred is to monitor the change in the platinum electrode potential after the addition of the modifying agent and during conditioning. Initially the platinum electrode potential decreases, i.e., it becomes more negative. Then the potential starts to increase, i.e., it becomes less negative. At the point where the potential begins to increase, conditioning is adequate and should be terminated.

After treating the ores as outlined above, the pulp is then immediately subjected to a flotation operation following the conventional flotation procedures well known in the art.

In an alternate embodiment of the present invention, the collectors, and even frothers, can be added with or immediately after addition of the surface modifying agent followed by conditioning for a time sufficient to provide intimate contact of the ore particles and the surface modifying agent as outlined previously. Immediately thereafter the ore is subjected to the flotation operation.

In order that those skilled in the art may readily appreciate the unique features and advantages of the present invention, the following examples, which are strictly illustrative and not to be construed as limiting in scope, are provided.

EXAMPLE 1

A porphyry ore containing a total of 0.89 wt. % of copper, 0.23 wt. % of which was in the form of oxide minerals, was ground with water to provide a pulp which had 25% solids. The solids were then ground in the presence of 2.5 kg/t lime such that about 55 wt. % passed through 200 mesh (U.S. standard mesh size). The pH was adjusted to 10.5 by adding additional lime. Next the ore was conditioned with a mixture of collectors and frothers. The collectors used were an amyl xanthate and a sodium secondary butyl dithiophosphate respectively sold under the name Cyanamid 350 and Cyanamid 238 by American Cyanamid Co., Wayne, N.J. The frothers used were pine oil, methyl isobutyl carbinol and a polyglycol sold under the name Dow-250 by Dow Chemical Co., Midland, MI. After conditioning with the collectors and frothers, the platinum electrode potential ($E_{Pt}$) was measured against a saturated calomel electrode. The ore was then subjected to successive flotation periods of 1 minute, 2 minutes and 4 minutes. At the beginning of each flotation period the platinum electrode potential of the ore was determined. Additionally the amount of ore floated for successive time periods was determined and the amount of copper in the flotation concentrate was determined. The results are shown below in Table I.

TABLE I

| Flot. Time, Min | $E_{Pt}$, mV | Flot. Rate, % Flot./min. | Flotation Assay, % Cu | Concentrate Dist., % |
|---|---|---|---|---|
| 0–1 | −50 | 59.9 | 13.6 | 59.9 |
| 1–3 | −40 | 4.4 | 9.8 | 8.8 |
| 3–7 | −25 | 1.1 | 5.1 | 4.6 |

EXAMPLE 2

Following the procedure set forth in Example 1, the ore pulp was first conditioned with a small amount of lime to bring the pH up to 10.5. Thereafter the slurry was conditioned with the collectors and frothers. To the slurry was added 0.5 kg/t sodium sulfide. The pulp was then conditioned for 1 minute, the redox potential was measured and the ore was floated for 1 minute. The same procedure of sodium sulfide addition, measurement of redox potential, and flotation was repeated at the end of 1 and 3 minute flotation periods. The results are given in Table II.

TABLE II

| Flot. Time, Min | $E_{Pt}$, mV | Flot. Rate, % Flot./min. | Flotation Assay, % Cu | Concentrate Dist., % |
|---|---|---|---|---|
| 0–1 | −385 | 69.9 | 14.2 | 69.9 |
| 1–3 | −295 | 6.3 | 6.4 | 12.6 |
| 3–7 | −300 | 0.8 | 2.5 | 3.3 |

As can be seen, the overall copper recovery and rate of flotation is greater when a surface modifying agent is employed than in the instance of Example 1 where no agent is used.

EXAMPLE 3

Following the procedure set forth in Example 2, the ore was treated using exactly the same procedure, except that 6.0 kg/t sodium hydroxide was used as surface modifying agent resulting in an increase in the pH to 12.0 and $E_{Pt}$ to below −200 mV. The results of these tests are given in Table III.

TABLE III

| Flot. Time, Min | $E_{Pt}$, mV | Flot. Rate, % Flot./min. | Flotation Assay, % Cu | Concentrate Dist., % |
|---|---|---|---|---|
| 0–1 | −215 | 62.7 | 13.2 | 62.7 |
| 1–3 | −150 | 7.1 | 9.59 | 14.1 |
| 3–7 | −135 | 1.0 | 5.2 | 4.1 |

As can be seen, use of sodium hydroxide for modifying the surface of oxidized sulfide minerals is effective in improving the overall recovery and flotation kinetics.

EXAMPLE 4

Following the general procedure set forth in Example 2, the ore was treated with sodium sulfide, except that only a single addition of 0.5 kg/t sodium sulfide was employed. The results of this test are given in Table IV.

TABLE IV

| Flot. Time, Min | $E_{Pt}$, mV | Flot. Rate, % Flot./min. | Flotation Assay, % Cu | Concentrate Dist., % |
|---|---|---|---|---|
| 0–1 | −280 | 70.0 | 13.7 | 70.0 |
| 1–3 | −85 | 5.0 | 8.3 | 10.1 |
| 3–7 | −45 | 0.8 | 3.7 | 3.2 |

Comparison of these results with those in Table II show that though flotation kinetics remained the same, the overall copper recovery is 2.5% lower than when only a single stage addition of sodium sulfide is used.

EXAMPLE 5

In this example an illustration of the effect of conditioning period is presented. This test was conducted in the same manner as that in Example 5, except that conditioning of the pulp was extended to 5 minutes, instead of 1 minute. The overall copper recovery decreased to 71.2% at a grade of 13.3% Cu. This recovery is lower than that obtained without the use of sodium sulfide in Example 1 and that obtained using sodium sulfide in Example 2, showing that excessive conditioning may lead to detrimental effects.

What is claimed is:

1. A process for recovering copper minerals from ores containing oxidized copper minerals in association with copper sulfide minerals comprising;

obtaining a pulp of the ore in water;

conditioning the pulp with an alkaline agent;

thereafter conditioning the pulp with a collector or mixture of collectors for copper minerals;

adding a surface modifying agent at a rate and an amount sufficient to decrease the platinum electrode potential when measured against a saturated calomel electrode of below about −100 mV, said surface modifying agent being selected from the group consisting of sodium sulfide, lime and sodium hydroxide;

conditioning the pulp with the surface modifying agent only until the platinum electrode potential of the pulp begins to become less negative; and thereafter subjecting the so treated ore to flotation to obtain a flotation concentrate and recovering copper minerals from said flotation concentrate.

2. The process of claim 1 wherein said alkaline pulp has a pH in the range of from about 8.5 to 11.0.

3. The process of claim 2 wherein said agent is sodium sulfide.

4. The process of claim 3 wherein said agent is added at a rate and in an amount sufficient to provide a platinum electrode potential of from −100 mV to −300 mV.

5. The process of claim 4 wherein said pulp is conditioned for from about 1 to about 2 minutes.

6. The process of claim 3 or 5 wherein said collectors and frothers are added with said surface modifying agent.

7. The process of claim 1 wherein the alkaline agent is selected from the group consisting of alkali metal carbonates, ammonium, potassium, and calcium hydroxide, lime and mixtures thereof.

8. The process of claim 7 wherein the alkaline agent is used in an amount sufficient to provide a pH greater than 8.5.

9. The process of claim 8 wherein the alkaline agent is lime.

10. The process of claim 9 wherein the collector is selected from the group consisting of xanthates, dithiophosphates, thiocarbonates and mercaptobenzothiozoles.

11. The process of claim 10 wherein the surface modifying agent is sodium sulfide.

12. The process of claim 11 wherein the pulp is conditioned with the surface modifying agent for less than 4 minutes.

13. The process of claim 12 wherein said pulp is conditioned for from about 1 to about 2 minutes.

14. In the flotation process for recovering copper values from ores containing oxidized copper sulfide minerals in association with copper sulfide minerals wherein said ores are conditioned with collectors for the copper minerals and frothers and thereafter subjected to flotation to recover said copper values, the improvement comprising adding a surface modifying agent to an alkaline pulp of said ore, said agent being selected from the group consisting of sodium sulfide, lime and sodium hydroxide, said agent added at a rate and in an amount sufficient to decrease the platinum electrode potential of said pulp when measured against a saturate calomel electrode to below −100 mV; conditioning said pulp with said surface modifying agent only until the platinum electrode potential of the pulp begins to become less negative and thereafter immediately subjecting said conditioned pulp to a flotation operation to obtain a flotation froth and recovering copper minerals from said flotation froth.

* * * * *